United States Patent [19]

Wheless

[11] Patent Number: 4,492,238

[45] Date of Patent: Jan. 8, 1985

[54] METHOD AND APPARATUS FOR PRODUCTION OF SMOKE FILTER COMPONENTS

[75] Inventor: Jack C. Wheless, Richmond, Va.

[73] Assignee: Philip Morris Incorporated, New York, N.Y.

[21] Appl. No.: 338,846

[22] Filed: Jan. 12, 1982

Related U.S. Application Data

[63] Continuation-in-part of Ser. No. 307,115, Sep. 30, 1981.

[51] Int. Cl.[3] ..... A24C 5/50

[52] U.S. Cl. ..... 131/94; 131/95; 425/383; 425/392; 493/43

[58] Field of Search ..... 131/95, 88–94, 131/264; 425/383, 392, 394, 396

[56] References Cited

U.S. PATENT DOCUMENTS

| | | |
|---|---|---|
| Re. 22,478 | 5/1944 | Perkins . |
| Re. 29,674 | 6/1978 | Labbe et al. . |
| 807,420 | 12/1905 | Copland . |
| 1,357,665 | 11/1920 | Watkins . |
| 1,606,058 | 11/1926 | Churchman . |
| 1,752,340 | 4/1930 | Hohn . |
| 1,993,402 | 3/1935 | Farrell . |
| 2,035,398 | 4/1936 | Muller . |
| 2,040,704 | 5/1936 | Modine . |
| 2,199,660 | 5/1940 | Eichorn . |
| 2,221,984 | 11/1940 | McKay . |
| 2,307,906 | 1/1943 | Ahne . |
| 2,335,710 | 11/1943 | Townsend . |
| 2,456,922 | 12/1948 | Cogovan . |
| 2,456,923 | 12/1948 | Cogovan et al. . |
| 2,464,301 | 3/1949 | Francis, Jr. . |
| 2,471,447 | 5/1949 | Perkins . |
| 2,628,540 | 3/1953 | Randall . |
| 2,649,761 | 8/1953 | Edwards . |
| 2,693,221 | 11/1954 | Lyijynen . |
| 2,694,399 | 11/1954 | Parker et al. . |
| 2,700,205 | 11/1955 | Rice . |
| 2,704,520 | 3/1955 | Rose et al. . |
| 2,723,937 | 11/1955 | Rice . |
| 2,803,188 | 8/1957 | Duvall . |
| 2,821,200 | 1/1958 | Körber . |
| 2,865,047 | 12/1958 | Mason . |
| 2,904,049 | 9/1959 | Körber . |
| 2,907,365 | 10/1959 | MacDonald . |
| 2,921,614 | 1/1960 | Vaughan . |
| 2,954,773 | 10/1960 | Lebert . |
| 2,964,441 | 12/1962 | Goldstone . |
| 3,017,304 | 1/1962 | Burgeni . |
| 3,032,829 | 5/1962 | Mahoney et al. . |
| 3,045,680 | 7/1962 | Smith . |
| 3,091,245 | 5/1963 | Rudszinat et al. . |
| 3,093,143 | 1/1963 | Rudszinat et al. . |
| 3,094,450 | 6/1963 | Davidson . |
| 3,103,220 | 9/1963 | Mahoney et al. . |
| 3,150,416 | 9/1964 | Such . |
| 3,164,157 | 1/1965 | Lebert . |
| 3,176,694 | 4/1965 | Kaeding . |
| 3,180,911 | 4/1965 | Muller . |
| 3,238,852 | 3/1966 | Schur et al. . |
| 3,240,213 | 3/1966 | Miller . |
| 3,255,494 | 6/1966 | Bloch et al. . |
| 3,304,943 | 2/1967 | Gunther . |
| 3,308,833 | 3/1967 | Dearsley . |
| 3,323,525 | 6/1967 | Miller . |
| 3,323,961 | 6/1967 | Gallagher . |
| 3,324,862 | 6/1967 | De Simone . |
| 3,336,928 | 8/1967 | Morehouse . |
| 3,353,329 | 11/1967 | Cloud et al. . |
| 3,379,814 | 4/1968 | Bracey et al. . |
| 3,390,684 | 7/1968 | Hudnell . |
| 3,428,050 | 2/1969 | Kandel . |
| 3,464,421 | 9/1969 | Pinkham et al. . |
| 3,470,884 | 10/1969 | McArthur . |
| 3,477,108 | 11/1969 | Stokes . |
| 3,483,873 | 12/1969 | Hinzmann . |
| 3,484,582 | 12/1969 | McArthur . |
| 3,490,461 | 1/1970 | Osmalov et al. . |
| 3,493,998 | 2/1970 | Mueller . |
| 3,495,434 | 2/1970 | Lavine . |
| 3,496,043 | 2/1970 | Ragan . |
| 3,527,234 | 9/1970 | Hinzmann . |
| 3,533,416 | 10/1970 | Berger et al. . |
| 3,538,210 | 11/1970 | Gatto . |
| 3,552,399 | 1/1971 | Andreas . |
| 3,556,907 | 1/1971 | Nystrand . |
| 3,577,995 | 5/1971 | White . |
| 3,577,996 | 5/1971 | Sherrill . |
| 3,579,623 | 5/1971 | Thomson et al. . |
| 3,596,663 | 8/1971 | Schultz et al. . |
| 3,599,646 | 8/1971 | Berger et al. . |
| 3,607,512 | 9/1971 | Mathe . |
| 3,608,561 | 9/1971 | Dock . |
| 3,621,851 | 11/1971 | Heskett et al. . |
| 3,637,447 | 1/1972 | Berger et al. . |
| 3,641,884 | 2/1972 | Jivoin . |
| 3,648,711 | 3/1972 | Berger et al. . |
| 3,674,619 | 7/1972 | Scher et al. . |
| 3,684,614 | 8/1972 | Lemelson . |
| 3,685,523 | 8/1972 | Labbe . |
| 3,690,326 | 8/1972 | Davenport . |
| 3,701,353 | 10/1972 | Pasquine et al. . |
| 3,702,118 | 11/1972 | Terasaki . |
| 3,703,429 | 11/1972 | Berger et al. . |
| 3,703,430 | 11/1971 | Rich . |
| 3,733,241 | 5/1973 | Mathe . |
| 3,733,246 | 5/1973 | Thomson et al. . |
| 3,735,672 | 5/1973 | Molins et al. . |
| 3,748,214 | 7/1973 | Withers . |
| 3,752,165 | 8/1973 | Harllee et al. . |
| 3,768,489 | 10/1973 | Kiefer et al. . |
| 3,773,053 | 11/1973 | Stephens, Jr. . |
| 3,773,883 | 7/1971 | Labbe et al. . |
| 3,774,508 | 11/1973 | Berger et al. . |
| 3,788,330 | 1/1974 | Griffith . |

| | | |
|---|---|---|
| 3,789,855 | 2/1974 | Norman . |
| 3,799,041 | 3/1974 | Van Hall . |
| 3,804,695 | 4/1974 | Randall et al. . |
| 3,805,682 | 4/1974 | Lyon et al. . |
| 3,805,801 | 4/1974 | Berger et al. . |
| 3,810,477 | 5/1974 | Berger et al. . |
| 3,811,451 | 5/1974 | Berger . |
| 3,817,158 | 6/1974 | Reinbeck et al. . |
| 3,826,177 | 7/1974 | Berger et al. . |
| 3,830,244 | 8/1974 | Luke . |
| 3,855,032 | 12/1974 | Luke . |
| 3,860,011 | 1/1975 | Norman . |
| 3,862,591 | 1/1975 | Cottrell . |
| 3,865,121 | 2/1975 | Molins et al. . |
| 3,958,579 | 5/1976 | Baker . |
| 3,964,493 | 6/1976 | Baker . |
| 3,985,144 | 11/1976 | Payne . |
| 4,007,745 | 2/1977 | Randall et al. . |
| 4,022,221 | 5/1977 | Berger . |
| 4,023,576 | 5/1977 | Norman . |
| 4,024,001 | 5/1977 | Lyon et al. . |
| 4,024,012 | 5/1977 | Sigmon . |
| 4,025,263 | 5/1977 | Morino et al. . |
| 4,026,306 | 5/1977 | Berger . |
| 4,033,362 | 7/1977 | Almqvist et al. . |
| 4,075,936 | 2/1978 | Berger . |
| 4,135,523 | 1/1979 | Luke et al. . |
| 4,140,137 | 2/1979 | Snow . |
| 4,149,546 | 4/1979 | Luke et al. . |
| 4,164,438 | 8/1979 | Lebet . |
| 4,213,470 | 7/1980 | Horsewell et al. . |
| 4,219,030 | 8/1980 | Hall . |
| 4,219,033 | 8/1980 | Horsewell et al. . |
| 4,232,574 | 11/1980 | Hall . |
| 4,256,122 | 3/1981 | Johnson . |
| 4,281,671 | 8/1981 | Byrne et al. . |
| 4,292,032 | 9/1981 | Luke . |
| 4,319,589 | 3/1982 | Labbe . |
| 4,324,540 | 4/1982 | Sexstone et al. . |
| 4,331,165 | 5/1982 | Farrar et al. . |
| 4,338,956 | 7/1982 | Sanford et al. . |
| 4,343,319 | 8/1982 | Cantrell . |
| 4,351,792 | 8/1982 | Sexstone et al. . |

FOREIGN PATENT DOCUMENTS

| | | |
|---|---|---|
| 728467 | 2/1966 | Canada . |
| 1145076 | 3/1956 | Fed. Rep. of Germany . |
| 1087958 | 8/1960 | Fed. Rep. of Germany . |
| 1145077 | 3/1963 | Fed. Rep. of Germany . |
| 1182571 | 3/1965 | Fed. Rep. of Germany . |
| 1632183 | 11/1970 | Fed. Rep. of Germany . |
| 71/2914 | 12/1971 | South Africa . |
| 73/8533 | 12/1973 | South Africa . |
| 864247 | 3/1961 | United Kingdom . |
| 898760 | 6/1962 | United Kingdom . |
| 1034584 | 6/1966 | United Kingdom . |
| 1251662 | 10/1971 | United Kingdom . |
| 1299805 | 12/1972 | United Kingdom . |
| 1308661 | 2/1973 | United Kingdom . |
| 1360611 | 7/1974 | United Kingdom . |
| 1360612 | 7/1974 | United Kingdom . |
| 1414745 | 11/1975 | United Kingdom . |
| 1421066 | 1/1976 | United Kingdom . |
| 2078086 | 1/1982 | United Kingdom . |
| 2078089 | 1/1982 | United Kingdom . |

*Primary Examiner*—V. Millin
*Attorney, Agent, or Firm*—Wayne M. Kennard

[57] ABSTRACT

A method is disclosed according to which a cylindrical object, such as a rod of smoke filter material, is pressed against a heated former element to form a permanent impression in one portion of the object as the former element and the object are simultaneously moved along a predetermined path. The object is then disengaged from the first former element, and pressed against a second heated former element to form a permanent impression in another portion thereof as the second former element and the object are moved along a second predetermined path, which may be an extension of the first, or not. Apparatus is disclosed, in one preferred embodiment of which the first and second former elements are disposed on the periphery of respective drums in such a manner that as the drums rotate in opposite directions, the object is transferred from the first to the second former element as the two former elements pass each other. In another embodiment, the first and second former elements are disposed on the periphery of a single drum, and a roller block adjacent the drum disengages the object from the first former element and rolls it along the drum periphery to the second. In a third embodiment, the object is rolled continuously but slowly along the periphery of a rotating drum on whose surface the former elements are disposed.

24 Claims, 5 Drawing Figures

METHOD AND APPARATUS FOR PRODUCTION OF SMOKE FILTER COMPONENTS

RELATED APPLICATIONS

This is a continuation-in-part of my copending application Ser. No. 307,115, filed Sept. 30, 1981.

BACKGROUND OF THE INVENTION

The present invention pertains to a method and an apparatus for imparting a desired shape to a cylindrical object such as a component of a smoke filter or other smoking apparatus. More particularly, it pertains to a method and apparatus for providing deformations of any desired shape in such an object, preferably by means of a combination of pressure and heat.

Cigarette filters comprising a cylindrical rod of cellulose acetate or another suitable filtering material are well known. The filtration of the tobacco smoke can be made more efficient by providing grooves of various shapes and sizes in the exterior peripheral surface of the filter rod. For example, U.S. Pat. No. 3,811,451, issued May 21, 1974, to Berger for a Tobacco Smoke Filter, discloses a filter of cellulose acetate containing a pouch filled with a more highly sorbent material such as activated charcoal, and having a plurality of longitudinal flutes which extend the greater part of the length of the filter from one end thereof.

U.S. Pat. No. 4,022,221, also to Berger, discloses a filter having, in one embodiment, a plurality of longitudinal flutes or grooves formed in the axially central portion of the external surface thereof. In another embodiment, the flutes extend from the end of the filter adjacent the tobacco rod to a point near the mouth end of the filter, and in a third embodiment, a helical groove is provided in the peripheral surface of the filter.

U.S. Pat. No. 3,768,489, issued Oct. 30, 1973, to Kiefer et al., for a Tobacco Smoke Filter, discloses a filter of cellulose acetate or the like, the filtration characteristics of which are improved by the provision of two longitudinal grooves in the exterior of the filter. The two grooves are located diametrically opposite each other and are axially offset from each other. In another embodiment, the two flutes are axially aligned with each other, and the ends of the filter are cut oblique to the axis thereof. In a third embodiment, a plurality of circumferentially adjacent grooves are provided on each side of the filter, and in a fourth embodiment a sectoral recess is formed on each side of the filter in place of the grooves.

The disclosures of U.S. Pat. Nos. 3,768,489, 3,811,451 and 4,022,221 are incorporated herein by reference.

Various methods for forming grooves, flutes, and other external deformations in filters are known. For example, in U.S. Pat. No. 3,811,451, the flutes are formed by means of crimping. In U.S. Pat. No. 4,022,221, it is similarly contemplated to form the flutes by means of crimping wheels such as those shown therein.

U.S. Pat. No. 4,164,438, issued Aug. 14, 1979, to Lebet for a "Method of Making Transverse Flow of Cigarette Filters", discloses a method and apparatus for forming grooves on opposite sides of a filter plug.

The filter plugs are first heated by exposure to high temperature water vapor or by means of high frequency electromagnetic radiation, for example, to plasticize the cellulose acetate of which they are made. After being heated, the filter plugs are shaped by means of a device comprising three drums rotating about parallel axes. Each of the drums has grooves formed in its peripheral surface parallel to its axis to receive the filter plugs.

Each filter plug is initially fed while in a heated state to the first drum, which receives it in a peripheral groove and carries it to the point where the first and second drums are closest. The gap between the first and second drums is quite small, and as the filter plug reaches the point it is deformed by an indenter disposed in a peripheral groove of the second drum, the first drum serving as a counterpunch. As the filter plug is deformed in this manner, it is simultaneously transferred from the first to the second drum, which then conveys it to the third drum, on which indenters are also disposed. As the filter plug reaches the gap between the second and third drums, it is deformed a second time by one of the indenters on the third drum. The second drum acts as a counterpunch for this process.

After the filter plug is punched for the second time, it remains on the second drum, which carries it to a fourth drum that removes it from the second drum by means of suction and then releases it into a discharge chute.

By this method, the filter rod is shaped by a series of very quick punching operations each of which is performed by a punch disposed on one drum while another drum, carrying the filter plug, serves as a counterpunch. In order for the desired shape to be impressed on a filter plug satisfactorily, the portion of the surface that is to be deformed must be in contact with the heated forming element for a certain minimum period of time which is a function of the filter plug material. Accordingly, the short time allotted by Lebet to form each groove in the filter plug would make it impossible to shape filter plugs at an acceptable speed.

Another method and apparatus for shaping filter rods are disclosed in U.S. Pat. No. 4,149,546, issued Apr. 17, 1979, to Luke et al. for the "Production of Tobacco-Smoke Filters". This patent discloses using a rotating drum to move the filter plugs past a stationary heated forming unit defined by the inner surface of an arcuate stator positioned adjacent the peripheral surface of the drum and spaced a uniform distance therefrom. The filter plugs are borne by the drum in a manner that permits them to rotate about their own longitudinal axes. The rotation of the drum carries each filter plug along the length of the stator. As this occurs, the filter plug, being free to rotate, rolls along the inner surface of the stator, the shape of which is imparted to the filter plug.

It is believed to be impossible, using the method disclosed by Luke et al., to shape filter plugs satisfactorily at a rate of more than 200–300 filter plugs per minute. Since a cigarette maker routinely produces about 4,000 cigarettes per minute, this low rate is unacceptable. The problem is believed to be that, using the method, the filter plugs remain in contact with the heated forming element a sufficient length of time to be properly shaped only if the drum is rotated at a relatively slow speed.

U.S. Pat. No. 3,483,873, issued Dec. 16, 1979, to Hinzmann, for an "Apparatus for Making Holes in Tobacco Rods or the like", discloses an apparatus in which holes are formed in a tobacco rod by means of pins provided in the periphery of a drum about which the tobacco rods are rolled by means of an adjacent endless belt.

It is accordingly the principal object of the invention to provide a method and an apparatus for forming cylin- FIG. 3 is a schematic side view of another detail of the embodiment of FIG. 1.

DETAILED DESCRIPTION OF THE PREFERRED EMBODIMENTS

Figure 1:
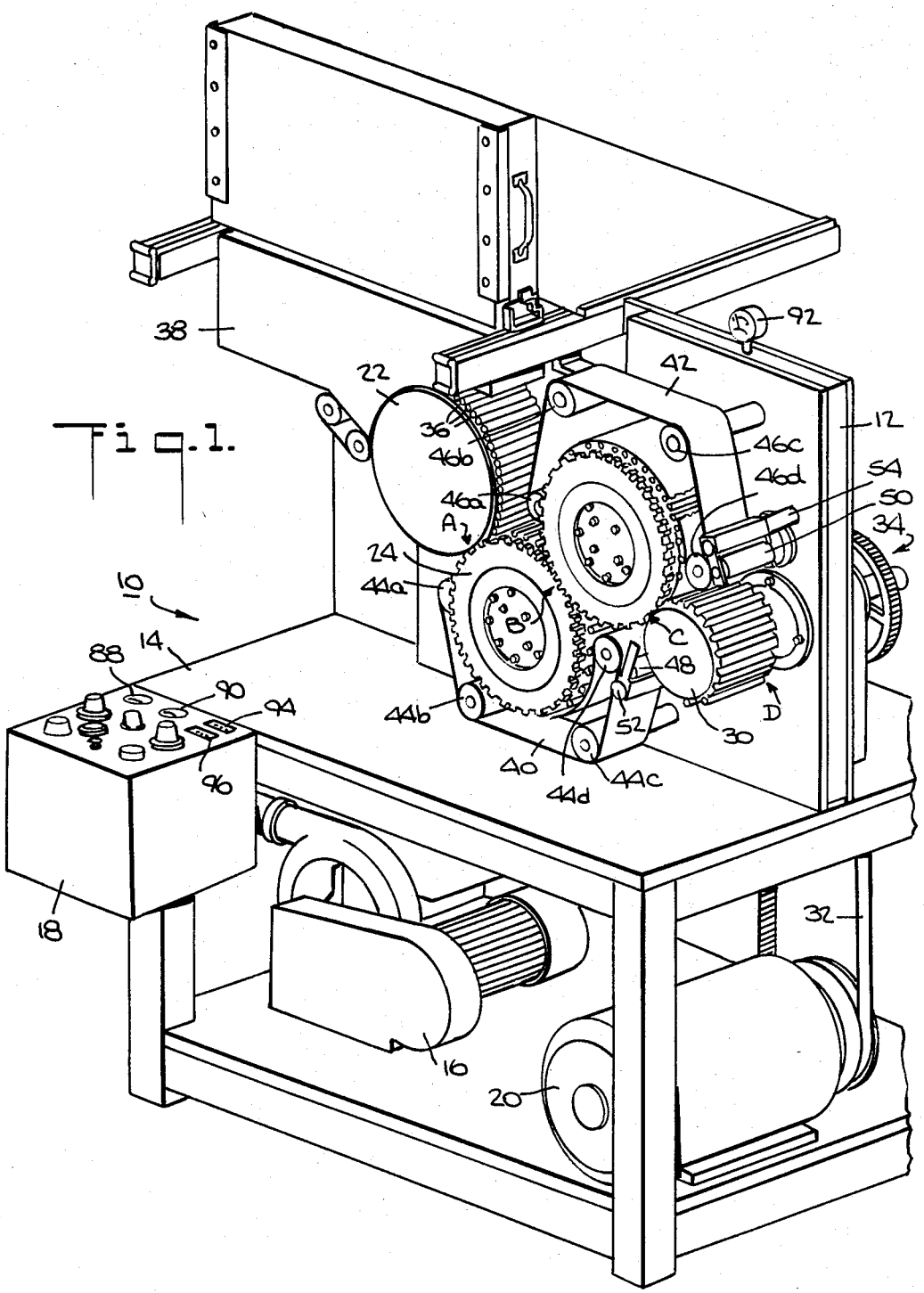

As shown in FIG. 1, one preferred embodiment of apparatus for carrying out the method of the invention is a free-standing unit 10. The article-forming apparatus proper is mounted on a vertical frame or panel 12 supported on a table 14. A vacuum fan 16 to provide vacuum suction for a purpose explained below, a control box 18 and a main drive electric motor 20 to power the apparatus and the vacuum fan 16 are also provided. The apparatus also includes a hopper drum 22, two heated drums 24, 26 carrying formers 28, and a final transfer drum 30, all mounted on panel 12 for rotation about respective horizontal axes by motor 20 via a drive belt 32 and a conventional system of gears 34 (not shown in detail).

Filter plugs 36 of cigarette smoke filter material, e.g. cellulose acetate, are stored in a hopper 38, from which they are dispensed one at a time to the hopper drum 22. A jam detector (not shown) of conventional design is provided on the hopper drum 22 to halt the operation of the filter feed in the event that a filter plug 36 becomes stuck in the hopper 38. The hopper drum 22 has grooves or flutes parallel to its axis disposed around its peripheral surface to receive the filter plugs 36, which are retained in the grooves by means of vacuum suction applied in a known manner by the vacuum fan 16 from the interior of the hopper drum 22 via small apertures (not shown) provided in the grooves for that purpose. Vacuum suction is similarly used to retain the filter plugs 36 in place on the other drums 24, 26 and 30.

The hopper drum 22 carries filter plugs 36 to point A, where they are transferred to the first heated drum 24. This transfer is preferably effected by simultaneously terminating the vacuum suction holding the filter plug 36 on the hopper drum 22 and applying vacuum suction to cause it to adhere to drum 24. Methods of controlling the vacuum suction to achieve this purpose are well known to those skilled in the art.

Figure 2:
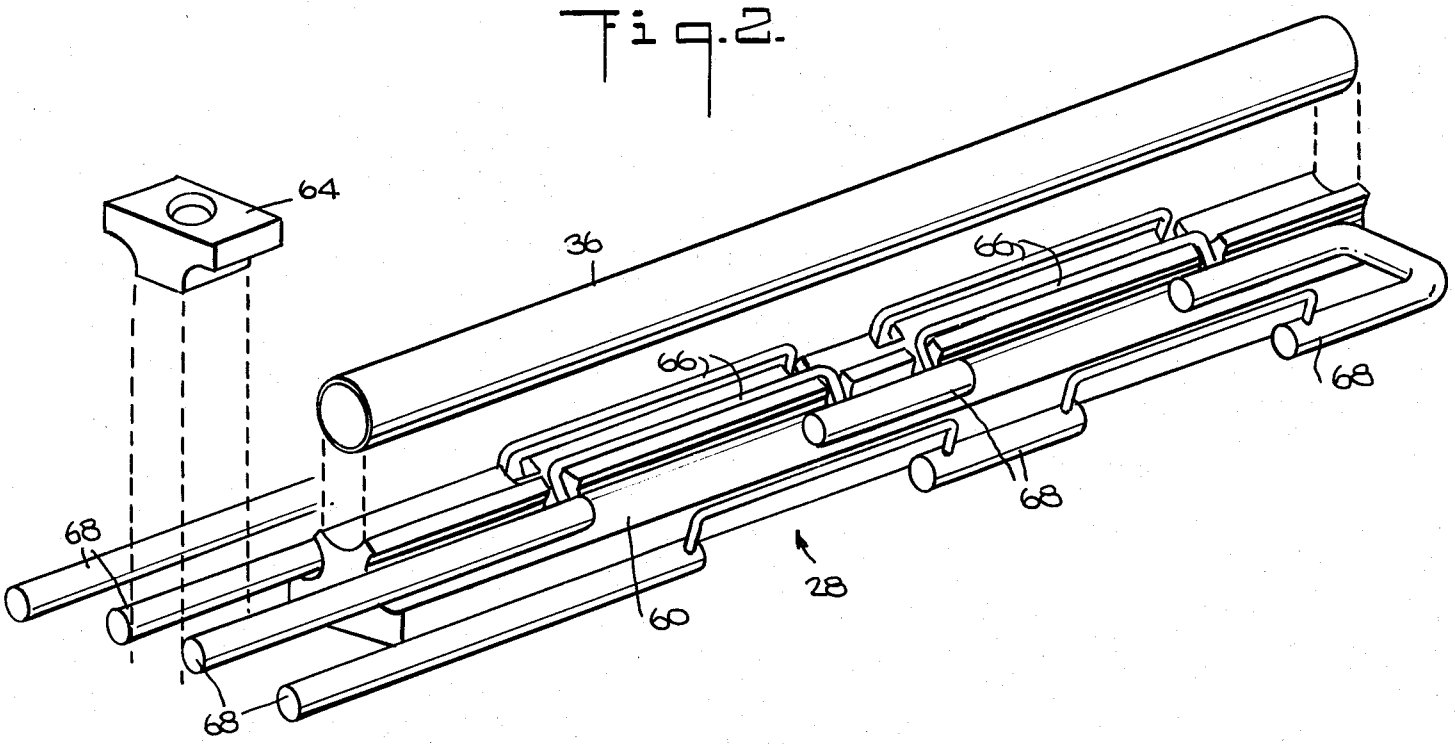

The heated drums 24, 26 are each provided in the embodiment shown with forty flute formers 28, one of which is shown more clearly in FIG. 2. (It will be understood that the number of formers can be varied according to convenience.) As can be seen from the Figures and as will be explained below, each flute former 28 defines a bed on which a filter plug 36 can be received. When each filter plug 36 reaches point A, it is released by the hopper drum 22 and received on the bed defined by one of the flute formers 28 of the first heated drum 24. As the drum 24 rotates, one side of the filter plug 36 is shaped by contact with the heated former 28.

The filter plug 36 is carried by the first heated drum 24 to point B, where it is transferred in the manner described above to a flute former 28 on the second heated drum 26. The latter shapes the other side of the filter plug 36 while transporting it to point C and then transfers it to the final transfer drum 30, which releases the flute filter plug 36 at point D. A conveyor belt (not shown) or other conventional means can be provided at point D to receive the filter plug 36 and take it to the next work station. These transfers are effected in the same manner as that from hopper drum 22 to drum 24.

First and second adjustable endless pressure belts 40, 42 are mounted on rollers 44*a–d* and 46*a–d*, respectively. As can be seen from the Figures, belts 40, 42 follow a portion of the peripheral surface of heated drum 24, 26, respectively, and press each filter plug 36 borne by the drums 24, 26 against the flute former 28 carrying it. The pressure exerted on the filter plugs 36 by belts 40, 42 can be adjusted by means of pressure rollers 58 (shown schematically in FIG. 3), which take up slack in the belt 40, 42. In addition, clamp rollers 48, 50 are mounted on panel 12 by means of shafts 52 and 54, and are spring biased rotatably around the axes of the shafts 52 and 54 in such a manner as to clamp the belts 40 and 42 against drive rollers 44*d* and 46*d* to ensure correct belt speed. The amount of the spring biasing is adjustable by conventional means (indicated schematically at 56 in FIG. 3).

The flute formers 28 have the structure shown in FIG. 2. Each flute former 28 comprises a heat resistant ceramic insert 60, which can for example be alumina ceramic, and which is received in a recess 62 in the periphery of the heated drum 24 or 26. The ceramic insert 60 has a generally T-shaped cross-section, the cross-piece of the T being received in the recess 62. The free end of the stem of the T is concave and serves as a bed to receive the filter plug 36, as indicated in FIG. 2. Clamps (not shown) made of electrically resistant material and screws (not shown) are used to secure the inserts 60 to the drums 24 and 26.

Figure 3:
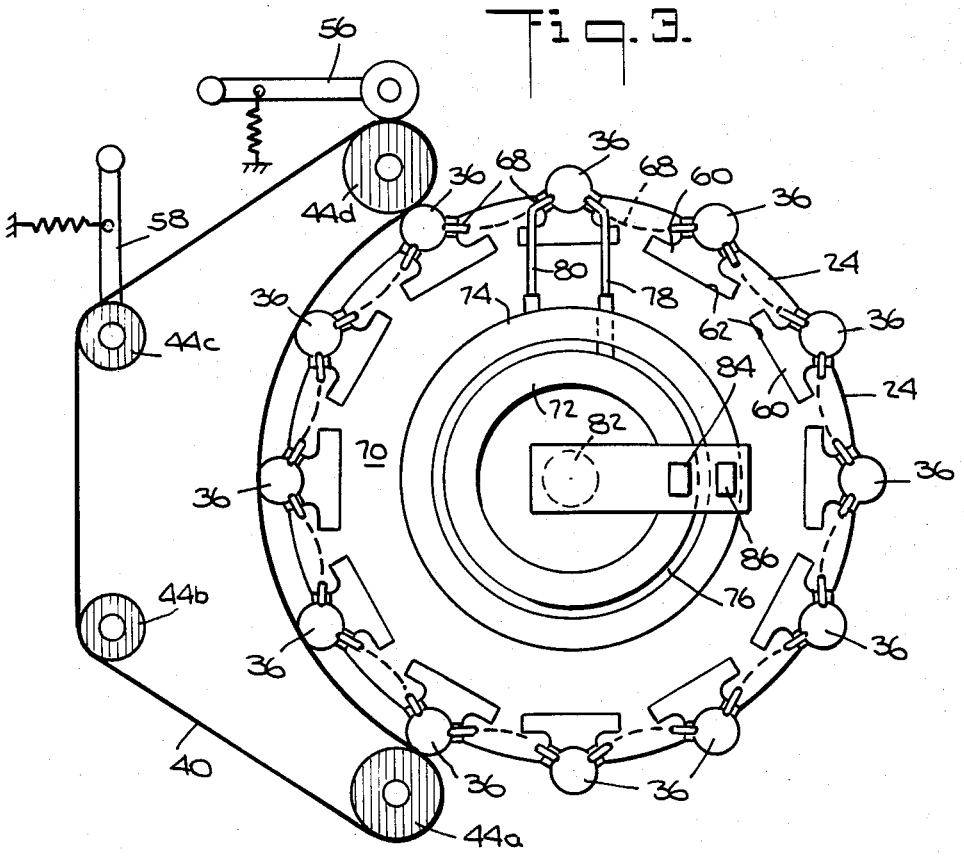

In the preferred embodiment shown in FIGS. 1–3 the filter plugs 36 are 4-up 108's, i.e. filter plugs 108 millimeters in length which will each be cut into four cigarette filters of 27 millimeters length. In this embodiment, the flutes to be formed are longitudinal and extend part of the way along the length of the filter from one end thereof.

When a filter rod 36 is placed on the former 28, four straight axial grooves or flutes are formed in one side of it by heated flute forming elements 66, which each comprise a length of, for example, ni-chrome wire bent into the shape of the flute to be made. The number and placement of the flute forming elements 66, as well as their shape, can be varied as needed. The pieces of ni-chrome flute forming elements wire 66 are soldered to lengths 68 of larger diameter copper wire in such a manner as to connect the four ni-chrome wires 66 of each former 28 with each other in series. The copper wires 68 are connected to those of the other flute formers 28 of the drum 24 or 26 by clamps 64 (one shown in FIG. 2), made of an electrically conductive material, such that all the ni-chrome wires 66 on a single drum are connected in series, as indicated in FIG. 3.

The design described above for the formers 28 could be simplified by replacing the copper wires 68 and the ni-chrome wire 66 with wire of a single thickness and material, for example, ni-chrome. It has been found in practice, however, that this arrangement is much less satisfactory than that shown in FIG. 2, because bending the ni-chrome wire to form it into the desired shape creates constrictions in it. The constrictions, having smaller cross-sections than the remaining portions of the wire, are regions of relatively high resistance. The ohmic heating produced in the bends is therefore considerably greater than that produced in the remaining portion of the length of the wires. This results in the formation of unsatisfactory flutes in the filter plugs 36. The structure shown in FIG. 2 avoids this problem.

The use of two types of wire having different diameters has an additional advantage. Since the copper wire, in addition to having a larger diameter than that of the ni-chrome wire 66, also has a lower resistivity than the latter, it will be apparent that the voltage drop per unit length of the copper wire 68 will be substantially lower than that occurring in the ni-chrome wires 66. The heat generated per unit length of the ni-chrome wires 66 will accordingly be substantially greater than that produced per unit length of the copper wires 68. The heat is concentrated in the areas where it is useful, that is, in the areas where the flutes are to be formed. The design shown in FIG. 2 thus reduces the power consumption of the apparatus of the invention.

The flute forming elements 66 are heated, as noted, by the passage of electric current through them. The means by which the current is supplied to them is shown in FIG. 3. (For the sake of clarity, FIG. 3 shows only twelve formers 28, rather than the actual number of about forty.)

The drums 24 and 26 each comprise an insulative body 70 in whose peripheral surface the recesses 62 receiving the ceramic inserts 60 are defined. Two annular conductive slip rings 72 and 74 are disposed in and concentric with the insulative body 70 and are spaced apart radially by an annular region 76 of insulative material. Two ni-chrome wires 78 and 80 electrically connect the two ends of the series circuit loop comprising the flute forming elements 66 to slip rings 72 and 74, respectively. Electrical power is supplied to the flute forming elements 66 by means of a power line 82 and is connected to two conductive brushes 84 and 86, which respectively connect the conductors of the power line 82 to slip rings 72 and 74. This arrangement provides current to the flute forming elements 66 to heat them.

The control box 18 is preferably provided with first and second meters 88 and 90, which respectively indicate the currents flowing at any instant through the flute forming elements 66 of the first and of the second heated drums 24 and 26 (These two currents can preferably be controlled independently.) A vacuum gauge 92 is also provided, for example, mounted on the vertical panel 12, to indicate the strength of the vacuum suction used to retain the filter plugs 36 in the grooves of the drums 22, 24, 26 and 30. In addition, a digital speed gauge 94 and a production counter 96 are provided to indicate, respectively, the number of filter plugs being processed per minute and the cumulative production since the beginning of the shift.

In operation, a filter plug 36 to be shaped is fed from the hopper 38 to the hopper drum 22, which transfers it to the first heated drum 24. Drum 24 carries the filter plug 36 from point A to point B as indicated in FIG. 1, and while carrying it forms four flutes in one side of it (see FIG. 2). The filter plug 36 is then transferred to point B to the second heated drum 26, which forms an additional four flutes in the other side of the filter plug 36 while carrying it to point C, where it is passed to the final transfer drum 30. The filter plug 36 is then carried to point D and released by drum 30 to be taken to the next work station.

It has been found that if all the flute forming elements 66 are the same diameter, the first four flutes formed in each filter plug 36 are slightly larger than the last four to be formed. The cause for this is believed to be that, during the formation of the first four flutes, most of the slack in the paper wrap is removed, causing a certain amount of shrinkage. As a result, when the last four flutes are made, the skin of the filter plug is tauter and therefore more difficult to deform than previously.

In order to overcome this problem, it is preferred that the flute forming elements 66 used to form the first four flutes should be slightly smaller in diameter than those used to make the last four flutes. It has been found especially suitable for the ni-chrome wires 66 of the flute formers 28 on the first drum 24 to be, for example, No. 20 gauge wire, and the ni-chrome wires 66 of the formers 28 of the second drum 26 to be, for example, No. 18 gauge wire. It has been found that this arrangement compensates for the shrinkage of the filter plug skin and results in the formation of flutes of equal size.

Up to 2,800 filter plugs per minute can be shaped using the double drum apparatus 10 described above. Since each filter plug is subsequently cut into from two to six filters (four in the embodiment shown), it will be clear that the apparatus described herein is capable of processing filters at least as fast as a cigarette maker can produce cigarettes.

Figure 4:
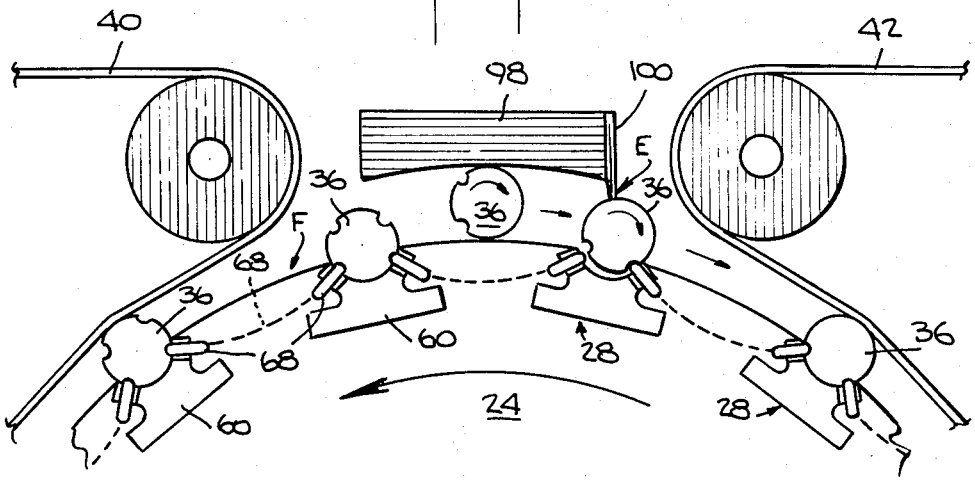
FIG. 4 is a schematic side view showing the essential features of a second preferred embodiment.

FIG. 4 shows another preferred embodiment of the invention, in which only one heated drum 24 is used in place of the two such drums 24, 26 employed in the embodiment of FIG. 1.

In the embodiment of FIG. 4, both sides of each filter plug 36 are shaped on the single heated drum 24, which is identical in structure to the heated drum 24 described above and hence will not be described in detail. Two pressure belts 40, 42 are arranged adjacent the periphery of drum 24 to press the filter plugs 36 against the flute forming elements 66. Pressure belts 40 and 42 are as described above, except that in the embodiment of FIG. 4 they are both adjacent the same heated drum 24. A kick-out mechanism in the form of a roll block 98 is positioned adjacent drum 24 between pressure belts 40 and 42. The end of the roll block 98 facing the oncoming stream of filter plugs 36 has a flange 100 extending toward the drum 24, the purpose of which is explained below.

The filter plugs 36 are supplied to drum 24 by the hopper drum (not shown in FIG. 4). Each filter plug 36 is received on a former 28 and held there by vacuum suction, as in the embodiment of FIG. 1. As the drum 24 rotates counterclockwise (in the view of FIG. 4) to carry the filter plug 36 to point E, the flute forming elements 66 it rests on form four flutes in one side of it. At point E, the filter plug 36 strikes flange 100 and is forced thereby off the flute former 28. This process can be facilitated by deactivating the vacuum suction applied to filter plug 36 when the filter plug 36 reaches point E.

The side of the roll block 98 facing the drum 24 is uniformly spaced from the surface of the drum 24 a distance equal to the diameter of the filter plugs 36. The roll block 98 therefore causes the filter plug 36 to roll along the drum surface after being knocked off the former 28 by the flange 100. The filter plug 36 is rolled in this manner onto the next flute former 28 (counting clockwise in FIG. 4), from which the roll block flange 100 has in the meantime ejected the filter plug 36 that previously occupied it.

In this embodiment the spacing between adjacent formers 28 is such that each filter plug 36 is rotated through a total angle equal to an odd number of half turns in being moved from one flute former 28 to the next by the roll block 98. The side of the filter plug 36 that has already been fluted while moving to point E now contacts the pressure belt 40 as the filter plug 36 is moved by the drum's rotation counterclockwise from point F, and the other side of the filter plug 36 is shaped. The filter plug 36 is then transferred to a final transfer drum (not shown in FIG. 4), which releases it for conveyance to the next work station, as in the embodiment of FIG. 1.

Figure 5:
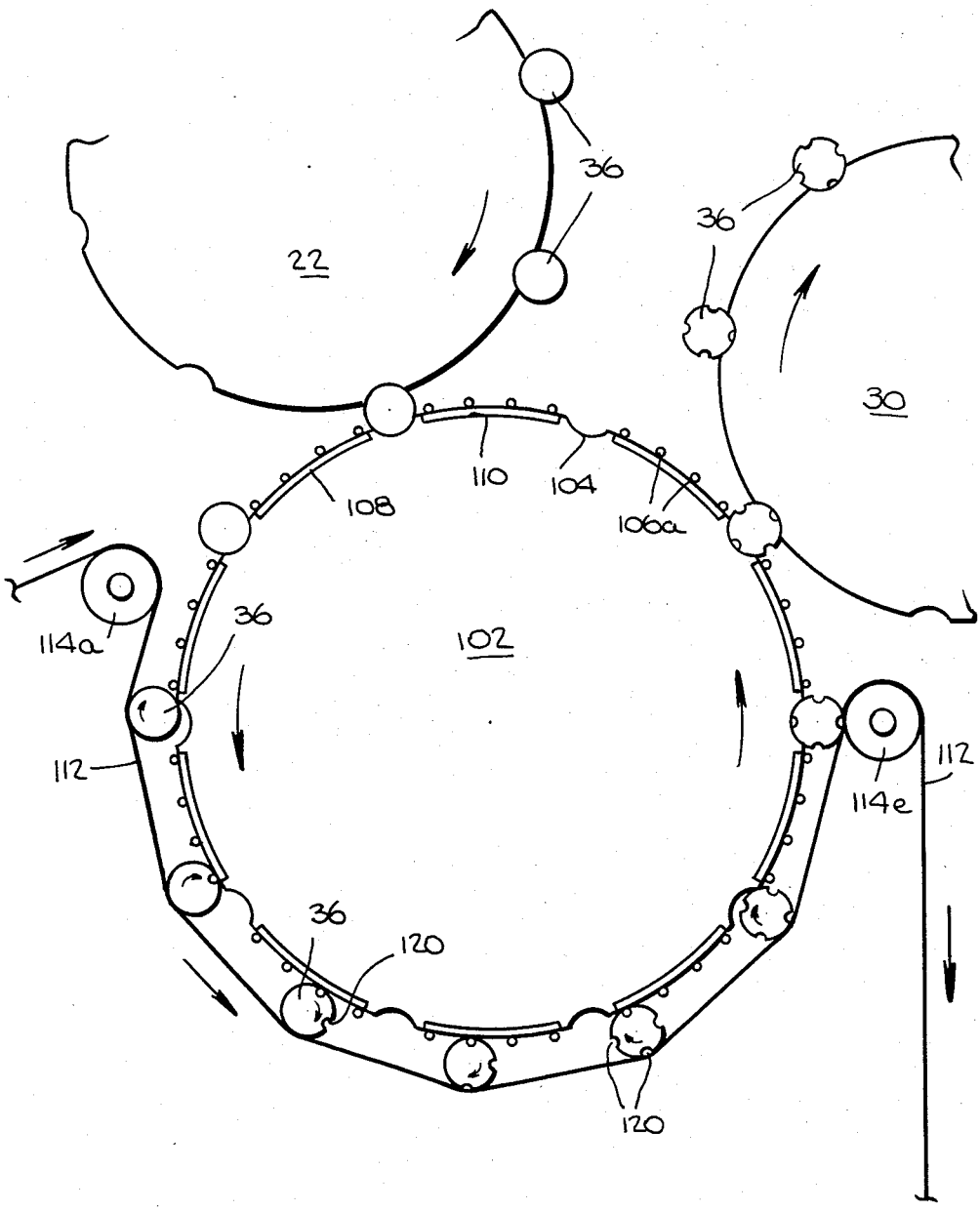
FIG. 5 is a schematic side view of a third preferred embodiment.

A third preferred embodiment of the invention is shown schematically in FIG. 5. In this embodiment, as in that of FIG. 4, a single heated drum 102 is used. The drum 102 has a relatively large number, for example, forty, grooves 104 provided equally spaced apart its periphery. (For the sake of clarity, only ten such grooves 104 are actually shown in FIG. 5.) In this embodiment the formers 28 each comprise four electrically heated ni-chrome wires 106*a*, 106*b* mounted in a ceramic insert 108 provided in a recess 110 in the drum periphery. Each ni-chrome wire is preferably connected to a current source by copper or other low-resistance wires in the manner shown in FIGS. 2 and 3. One such former 28 is provided between each two of the drum grooves 104, the two forward wires 106*a* of each former 28 preferably being No. 20 gauge wire and the two rearward wires 106*b* being No. 18 gauge wire for the reasons explained above in connection with the embodiment of FIGS. 1–3.

The hopper drum 22 and the off-take drum or final transfer drum 30 are both located adjacent the heated drum 102. Both are substantially as described in connection with the embodiment of FIGS. 1–3 and therefore will not be described again.

A single pressure belt 112 is provided adjacent the drum 102. The belt is mounted on several rollers, of which two rollers 114*a* and 114*e* are shown, and is wrapped around approximately 300° of the periphery of the drum 102. A device (not shown in FIG. 5 but like that shown in FIG. 3) is provided to take up slack in the belt 112, and to adjust the pressure the belt 112 exerts on the filter plugs 36. The belt 112 is driven at a speed slightly different from the speed of rotation of the drum 102.

The filter rods 36 are fed to the drum 102 by the hopper drum 22, as in the embodiments described above. Each filter plug 36 is received in a respective groove 104, where it is held by vacuum suction. As the drum 102 rotates, the slight speed differential between it and the belt 112 causes the filter plugs 36 to roll along the surface of the drum 102. Preferably, the belt 112 moves more slowly than the drum 102, causing the filter plugs 36 to roll backward relative to the drum surface. This relative motion of the filter plugs 36 and the drum 102 causes each filter plug 36 to roll backward over a former 28. The speed differential is such that each filter plug 36 rolls backward one drum groove 104, in the process rolling over four of the ni-chrome wires 106*a*, 106*b* while being carried by the drum 102. As a result, each filter plug 36 has four equally spaced longitudinal flutes 120 at the time it is transferred from the heated drum 102 to the off-take drum 30.

It will be appreciated that the straight ni-chrome wires shown and described with reference to the preferred embodiments could be replaced with flute forming elements having any desired shape. In addition, formers of several different shapes could be provided on one drum. In the embodiment of FIG. 5, for example, formers of n different shapes could be disposed in succession on the drum periphery, one former between each two adjacent drum grooves. In this case, the difference in speed between the drum periphery and the belt 112 would be such as to roll each filter plug 36 a distance of n grooves 104 along the drum surface.

Those skilled in the art will appreciate that instead of using a free standing machine, the method of invention could be practised by incorporating any of the embodiments described above in a machine that processes the fluted filter plugs further. For example, the final transfer drum could be employed to deliver the filter plugs directly to a cutter to be cut into doubles, i.e. segments comprising two filters end to end. The doubles would then be attached to tobacco rods and severed to yield finished cigarettes.

In addition, instead of disposing the formers on the periphery on one or more drums, they could be supported for transportation along any desired predetermined path, provided only that enough pressure can be maintained on the filter plugs while in contact with the formers to ensure that the desired deformation occurs.

The specific embodiments described herein are merely illustrative of the present invention, the true scope of which is set forth in and determined solely by the appended claims.

What is claimed is:

1. An apparatus for shaping a cylindrical object, comprising:

transport means for transporting a cylindrical object along a first predetermined path;

a plurality of heated former means disposed on said transport means, for thermally deforming a portion of the cylindrical object to impart a predetermined desired shape thereto; and means moving adjacent to and independent of said transport means for maintaining the cylindrical object in operative contact with at least one of said former means for a sufficient length of time to cause said predetermined shape to be imparted to the cylindrical object while said transport means is transporting the cylindrical object along said first predetermined path.

2. The apparatus of claim 1, wherein said maintaining means includes adjustable endless belt means for pressing the cylindrical object against at least one of said former means with an adjustable pressure.

3. The apparatus of claim 1, wherein each said former means comprises a conductive element heated by the passage therethrough of an electric current.

4. The apparatus of claim 3, wherein said conductive element includes a high-resistance portion having a shape to be imparted to the cylindrical object, and a low-resistance portion having a lower electrical resistance per unit length than said high-resistance portion.

5. The apparatus of claim 4, wherein said high-resistance portion comprises a ni-chrome wire portion having a first cross-sectional area and a first resistivity, and wherein said low-resistance portion comprises a copper wire portion having a second cross-sectional area greater than said first cross-sectional area and having a second resistivity lower than said first resistivity.

6. The apparatus of claim 1, further comprising second transport means having a plurality of heated former means disposed on it, said second transport means being for receiving the cylindrical object from said first transport means and for transporting it along a second predetermined path; said maintaining means further being for maintaining the cylindrical object in operative contact with at least one of said former means disposed on said second transport means for imparting a desired shape thereto.

7. The apparatus of claim 6, wherein said first and second transport means are arranged to enable a cylindrical object to be transferred directly from one said former means disposed on said first transport means to one said former means disposed on said second transport means, in such a manner that the cylindrical object is deformed on one side while being carried by said first transport means and on another side while being carried by said second transport means.

8. The apparatus of claim 6, wherein each said former means includes a conductive element heated by the passage therethrough of an electric current, said conductive element including a wire having a shape for forming a flute in the cylindrical object; said wires of said former means of said first transport means being smaller in diameter than said wires of said former means of said second transport means.

9. The apparatus of claim 6, wherein the magnitudes of said electrical currents flowing through said former means of said first and second transport means, respectively, are controllable independently of each other.

10. The apparatus of claim 6, wherein each said transport means comprises a respective rotary drum having a respective said former means disposed on the periphery thereof.

11. The apparatus of claim 1, further comprising kick-out means located adjacent said transport means for removing a cylindrical object from one said former means after it has been deformed thereby on one side, and placing it in a second said former means to be deformed on its other side.

12. The apparatus of claim 11, wherein said kick-out means comprises a stationary roll block spaced from said transport means by a distance approximately equal to the diameter of the cylindrical object.

13. The apparatus of claim 11, wherein said transport means comprises a rotary drum having said former means disposed on its periphery.

14. The apparatus of claim 1, wherein said first transport means is a drum having a plurality of grooves defined in its peripheral surface to receive cylindrical objects, and wherein each said former means is disposed between a respective pair of adjacent ones of said grooves.

15. The apparatus of claim 14, wherein all said former means are identical.

16. The apparatus of claim 14, wherein each said former means comprises four wires, each said wire having a shape for forming a single flute in a cylindrical object.

17. A method for shaping a cylindrical object, comprising the steps of: moving a cylindrical object along a first predetermined path while maintaining it in operative contact with, and stationary relative to, a first heated former to impart a predetermined desired shape to one portion of the cylindrical object; and then moving the cylindrical object along a second predetermined path while maintaining it in operative contact with, and stationary relative to, a second heated former to impart a predetermined desired shape to another portion of the cylindrical object.

18. The method of claim 17, wherein said first and second paths are circular arcs that lie on a single circle; and further comprising the step of removing the cylindrical object from said first former, and moving it along said circle to said second former after it has been shaped by said first former and before it is shaped by said second former.

19. The method of claim 17, wherein said first and second formers are supported on first and second rotatable drums for motion along said first and second paths, respectively; and further comprising the step of transferring the cylindrical object from said first former directly to said second former.

20. A method for shaping a cylindrical object, comprising the steps of: moving a cylindrical object along a predetermined path at a first speed; simultaneously moving a heated former along said path at a second speed different from said first speed; and, while moving the cylindrical object, bringing it into operative contact with said heated former to impart a desired shape to the cylindrical object.

21. The method of claim 20, wherein said second speed is greater than said first speed.

22. The method of claim 20, wherein said path is a circular one, and wherein said formers are supported on a drum for movement along said path by rotation of said drum, and wherein the cylindrical object is rolled along the peripheral surface of said drum by an endless belt moving at a speed different from that of said drum to bring the cylindrical object into operative contact with said heated former.

23. The apparatus of claim 1, wherein said maintaining means is further for maintaining a cylindrical object stationary relative to said at least one former means for imparting said predetermined shape to the cylindrical object.

24. An apparatus for shaping a cylindrical object, comprising:

transport means for transporting a cylindrical object along a first predetermined path;

a plurality of heat former means disposed on and being transported with said transport means, for thermally deforming a portion of the cylindrical object to impart a predetermined shape thereto; and means for maintaining the cylindrical object in operative contact with at least one of said former means for a sufficient length of time to cause said predetermined shape to be imparted to the cylindrical object while said transport means is transporting the cylindrical object along said first predetermined path.

* * * * *